US005183158A

United States Patent [19]

Boyd et al.

[11] Patent Number: 5,183,158

[45] Date of Patent: Feb. 2, 1993

[54] BAG DISPENSING SYSTEM AND BAG PACK

[75] Inventor: Dana M. Boyd, Rushville; William J. Randolph Jr., Marion, both of N.Y.

[73] Assignee: Mobil Oil Corporation, Fairfax, Va.

[21] Appl. No.: 914,657

[22] Filed: Jul. 17, 1992

Related U.S. Application Data

[63] Continuation of Ser. No. 713,223, Jun. 11, 1991, abandoned.

[51] Int. Cl.[5] ..... B65D 27/10

[52] U.S. Cl. ..... 206/554; 383/9; 383/37

[58] Field of Search ..... 206/495, 554, 806; 383/7, 9, 37, 903; 493/196, 203, 204

[56] References Cited

U.S. PATENT DOCUMENTS

| | | | |
|---|---|---|---|
| 3,587,844 | 6/1971 | Wing | 206/554 |
| 4,106,734 | 8/1978 | Walitalo | 248/100 |
| 4,165,832 | 8/1979 | Kuklies et al. | 229/54 |
| 4,476,979 | 10/1984 | Reimann et al. | 206/554 |
| 4,562,925 | 1/1986 | Pistner | 206/554 |
| 4,676,378 | 6/1987 | Baxley et al. | 206/554 |
| 4,769,126 | 9/1988 | Roen et al. | 383/7 |
| 4,785,938 | 11/1988 | Benoit, Jr. et al. | 206/554 |
| 4,796,759 | 1/1989 | Schisler | 206/554 |
| 4,811,417 | 3/1989 | Prince et al. | 383/9 |
| 4,989,732 | 2/1991 | Smith | 383/9 |
| 5,014,582 | 5/1991 | Herrington et al. | 206/554 |

*Primary Examiner*—David T. Fidei
*Attorney, Agent, or Firm*—A. J. McKillop; C. J. Speciale; J. P. O'Sullivan, Sr.

[57] ABSTRACT

A pack of grocery sacks has releasable adhesive regions between contacting walls of adjacent sacks in order to insure the substantial opening of a following sack when a lead sack is removed from a rack supporting the pack.

12 Claims, 1 Drawing Sheet

BAG DISPENSING SYSTEM AND BAG PACK

This is a continuation of copending application Ser. No. 07/713,223, filed on June 11, 1991, now abandoned.

The present invention relates to unitized packs of thermoplastic film bag structures having integral vertically extended handles and a system for dispensing the same, which system is designed to more fully open the bags to be loaded.

BACKGROUND OF THE INVENTION

U.S. Pat. No. 4,165,832 to Kuklies et al, discloses packs of thermoplastic grocery sacks wherein the individual bags are designed to be held in registration by being thermally welded together at a suspension tab member which extends from the center region of the bag mouth. While this type of unitization is effective in maintaining the sacks in secure uniform registration at the bag mouth region, they do not keep the handles in registration. Such a bag pack is structured to be suspended from the center of the pack and it is awkward during dispensing and bag filling to deal with the loose unsecured handles particularly in bag packs containing over 100 bags in the pack.

U.S. Pat. No. 4,106,734 to Walitalo is directed to handleless plastic bags which are held in registration by employing a small adhesive area below the bag mouth of the front ply of each bag so that it contacts the back ply of the next bag in the stack. Thus, in addition to maintaining the bags in registration at the bag mouth region this feature also will assist in at least partially opening the bag mouth as each preceding filled bag is removed from the pack.

U.S. Pat. No. 4,796,759 to Schisler is directed to a pack of thermoplastic film handled grocery sacks. A hole is present in each handle so as to receive a rod therethrough designed to support the bag pack by the handles. A center support tab extends from the mouth of each bag and the tabs are joined together by welding or gluing to secure the bags in a pack. A line of perforations separate the support tab from the bag mouth. Below the perforation line of each bag is a "glued or welded localized zones 9" which insures connection between the rear wall of one bag and the front wall of the next bag and so on through the bag pack. Above this point 9, the welded-together support tabs maintain the bags in registration and the localized glued or welded zones 9 assists in opening the top of the bags during the dispensing and loading of the same. This construction has the disadvantage that no provision is made for maintaining the handles in registration prior to mounting the pack on a dispensing rack.

U.S. Pat. No. 4,676,378 issued to Baxley et al is directed to a pack of thermoplastic film grocery sacks having integral handles extending therefrom. Each handle has an arcuate cut surrounding a tab-like member therein, so as to receive a support rod through the cut which supports the bag pack from the handles during bag dispensing and filling. During manufacture of the bag pack, a heated member fuses the individual orifice tabs together in order to make it easier to thread the bag handles onto the support rods. In order to accomplish this result, a complex and intricate cutting and hot pin welding device is required.

U.S. Pat. No. 4,811,417 to Prince et al shows a bag pack having vertical slit supports in the handles and the handles are melt-bonded together at the top by means of a heated pin device.

U.S. Pat. No. 4,989,732 to Smith shows a bag pack and dispensing system wherein the bags of the pack are releasably pressure bonded together in areas of the handles alone or in combination with an area of the bag mouth.

It is a principal object of the present invention to provide a pack of thermoplastic film grocery sacks having integrally extended handles with support means in association with the handles and providing means whereby a bag to be loaded is more fully opened.

SUMMARY OF THE INVENTION

The present invention is directed to a pack of thermoplastic film bags, said bags being in at least approximate registration, each bag comprising a bottom, front and rear walls connected by way of gusseted side walls, a bag mouth, double film loop handles at opposite ends of the bag mouth, said handles being integral extensions of said walls. The pack has pack suspension means intermediate the top and the base of the handles. There is a first releasable means between the upper rear portion and the upper front portion of each bag to cause an initial opening of the top region of a next bag during removal of a lead bag from the pack and a second releasable means between the lower portion of each rear and front bag wall to cause a more complete opening of said next bag on removal of said lead bag by the handles thereof.

The invention is also concerned with a system for suspending and dispensing plastic film bags comprising:

(a) a pack of thermoplastic film bags, said bags being in at least approximate registration, each bag comprising a bottom, front and rear walls connected by way of gusseted side walls, a bag mouth, double film loop handles at opposite ends of said mouth, said handles being integral extensions of said walls, said handles having suspension orifices intermediate the top and the base of the handles; first releasable means between the upper rear portion and the upper front portion of each bag to cause an initial opening of the top region of a next bag during removal of a lead bag from the pack and a second releasable means between the lower portion of each rear and front bag wall to cause a more complete opening of said next bag on removal of said lead bag by the handles thereof;

(b) a rack for holding said bag pack comprising a pair of spaced parallel cantilevered handle support rods having free outer ends, said rods functioning to support said bag pack from said handle suspension orifices; and whereby on removal of a lead bag from a rack suspended pack, said first releasable means causes an initial opening of the top region of the next bag and said second releasable means causes a more complete opening of said next bag.

DETAILED DESCRIPTION OF THE INVENTION

This present invention is an improvement over that disclosed in U.S. Pat. No. 4,989,732, issued to Smith. The improvement resides in the fact that the presently disclosed system and bag pack permits individual bags to be more or less fully opened automatically during use, rather than only the top region.

Figure 1:
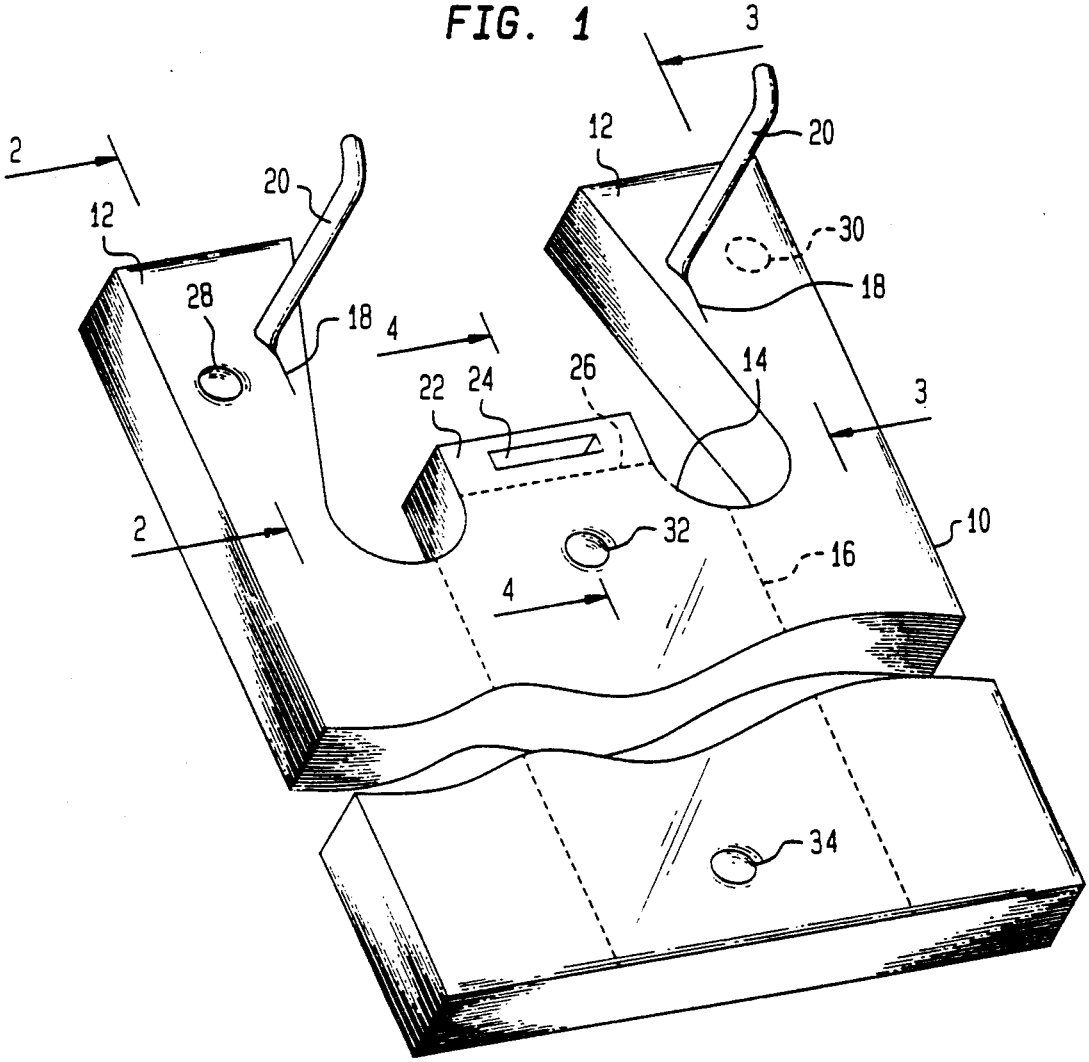
FIG. 1 is a perspective view of an assembled pack of bags shown suspended from support rods.

One form of bag structure of the present invention, shown in FIG. 1 of the accompanying drawing, generally comprises a pack of superimposed layflat registered bags. These bags are fabricated from a flattened gusseted thermoplastic tube which has been sealed across the width thereof top and bottom at a bag-length distance apart. The thermoplastic material is typically one of the species of polyethylene, its copolymers or blends. Such sealed, flattened, gussetted, thermoplastic tubes are known in the art as sealed pillowcases. Such pillowcases are stacked one upon the other until the number of pillowcases desired in the pack is reached. Thereafter, a suitable cutting means removes thermoplastic film from all of the pillowcases at one end thereof. The cutting means is designed to create integral double loop handles and a bag mouth such as the type shown in FIG. 1.

Thus bag pack 10 is made up of a plurality of individual thermoplastic film grocery sacks positioned in registration one upon the other. At the top thereof, each bag has double film loop handles 12 at opposite ends of an open mouth region 14. The handles have double film loops by virtue of the gussetted construction of the bag. Dotted line 16 illustrates a preferred inward extent of the gussets on both sides of the bag.

Each handle is shown as having a slit orifice 18 which accommodates handle support rods 20 which extend through the slit orifices. Obviously any shape orifice can be employed.

FIG. 1 also shows a suspension tab 22 which can be optionally in association with the bag mouth region of the bag in different ways. For example, a tab of the shape shown can be attached to the front panel of the bag by means of a perforation line 26. An identical tab 22 can likewise be attached to the back panel of the bag. The tabs of all of the bags are then placed in registration and the tabs are bonded together in some suitable manner so that a suspension orifice 24 is in alignment through all of the tabs. It is also contemplated to eliminate the center tabs altogether.

The perforation line 26, which connects the front panel of the bag with the front suspension tab, is an optional structure. The bags can be fashioned so that front tab 22 is not attached at all to the front panel of the bag. In this arrangement, access to the bag mouth of the front panel can be accomplished without there being any impediment to accessing the bag mouth. A quick movement of the hand down across the front tab 22 will access the bag mouth since the edge will not be connected to front tab 22. Only the back tab would be attached through perforations to the back panel.

For certain manufacturing reasons, it may be more practical to permit the front panel at the bag mouth region to be connected to the front suspension tab 22 at a few points instead of a continuous perforation line. If, for example, the front panel of the bag in the bag mouth region is attached to the front suspension tab 22 at two very narrow points, then during transport of the pillowcase during manufacture, this will prevent air from entering between the front panel and the back panel of the pillowcase and disturbing an orderly manufacture.

On the other hand, if air disturbance is not a problem or can be adequately coped with, then the front panel need not be attached at all to tab 22. This is what is known as having a "front side free" structure. As indicated above, the advantage of this arrangement is that it permits rapid dispensing and filling of the individual bags. The bagger can immediately access the front of the bag with a wipe of the hand since it does not have to be severed from tab 22.

As indicated above, in certain instances employing a handle support system, the bags need not have a bag mouth support arrangement at all. That is, tabs 22 need not be present in the structure at all.

In order to accomplish the principal object of the present invention, certain releasable means are employed between the both the upper and lower regions of each bag in the bag pack. As employed herein the term "releasable means" is intended to cover any technique by which, during the removal of one bag from a suspended bag pack, a releasable force will pull forward the front panel of a following bag. The adhesion between bags cannot be too great or else the removal of one bag, all will remain connected and the bags will be pulled off in a chain-like interconnected fashion. The releasable means must only be aggressive enough to cause the front panel of the bag to separate from the back panel of the bag to a certain extent, and, as the weight and construction presents its resistance, the releasable means is designed to release the departing bag from the next following bag.

Examples of releasable means include any one or combination of such releasable means. A low-tack pressure sensitive adhesive of any type can be employed between the back and front panel of each bag. Another example involves the use of a corona discharge treated area at adjacent regions of the back panel of one bag and the front panel of the next, in combination with the application of pressure. This treatment will cause the respective films to adhere together until overcome by a comparatively small separating force. A third example is to merely employ considerable pressure through the layers of the bag pack in order to achieve a releasable adhesion between the rear portion and front portion of each bag. This technique will be employed in order to illustrate the present invention.

Figure 2:
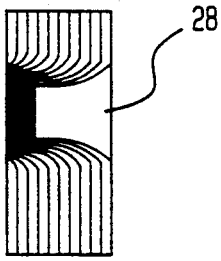
FIG. 2 shows a section of the left handle region cut away along line 2—2 of FIG. 1.

Located in each handle and optionally in the upper center region of the bag mouth, are compressed areas 28, 30 and 32. These areas, which can vary in size and shape, comprise regions that have been forcibly compressed so as to bring the areas of film into extremely intimate, face-to-face contact. The force of compression should be such that substantially all air space is eliminated from between the film regions being compressed. With respect to area 28 of the left hand handle of the bag pack, pressure has been applied from the top, while the bag handles have been supported by a flat support service, e.g. teflon, hard rubber etc. This results in the creation of a depression or partial nesting arrangement of the layers of film. Obviously, the outer most region will be involved in a stretching of its film as shown in FIG. 2. The area of compression shown at 28 can be approximately a circle of any convenient size, e.g. from 1/32 in. to over 1 in. in diameter. The effect of this compression will be that the layers of film making up the stack of handles will stay in registration after compression and during normal reasonable handling, during shipment to a customer and up to the time the bagger threads the bag handle onto support rods 20. The releasable means 28, 32 and 30 will not in and of themselves cause the bag to fully open as a proceeding bag is taken away. The bottom region of the bag will tend to remain in its collapsed condition.

It has been discovered that by placing a second releasable means between the lower portion of each rear and front bag wall, this will, to a much greater extent, cause the bottom of the bag to open. In many instances this will cause the bag to fully open. Thus, a second releasable means, such as that shown at 34 in FIG. 1, is positioned between the lower portion of each rear and front bag wall to accomplish this result. It is of course understood that more than one releasable region can be positioned between adjacent bags. A continuous band of adhesion can be created from one side of the bag to the other in order to accomplish this result.

Figure 3:
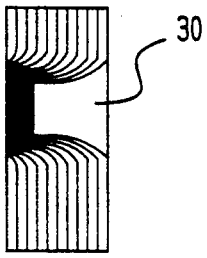
FIG. 3 shows a section of the right handle taken along the line 3—3 of FIG. 1.
Figure 4:
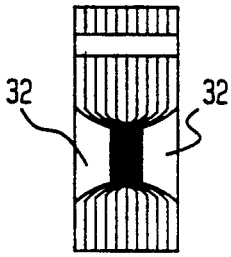
FIG. 4 shows a section of the center region of the tab and bag mouth of the bag pack taken along line 4—4 of FIG. 1.

The compressed region 30, shown in the right-hand handle of the bag pack of FIG. 1, shows compressed region 30 but in the reverse relationship of that of compressed area 28. As shown at 32 the compressed regions can be formed by applying equal areas of pressure from opposite directions so as to result in equal and opposite nested regions 32 as shown in FIG. 4. Releasable region 34 can be formed as shown in FIG. 2, FIG. 3 or FIG. 4. In addition, as mentioned above, conventional adhesives can be employed so long as the normal forces involved in separating a lead bag from a following bag will overcome the aggression of the adhesive.

The beneficial effect of the compressed or adhesively bonded regions will be understood to operate to keep the bags of the bag pack in a fixed approximate registration during transport to the ultimate user who can then thread the bag packs onto the support members without difficulty. It is not necessary to employ the 3 different kinds of compressed areas, any type of releasable means can be employed.

The described bags can be made of any of the usual thermoplastic film material employed for such bags. A suitable thermoplastic film material is generically polyethylene, which includes, low, medium and high density polyethylenes. In addition, a copolymer of ethylene and another alpha-olefin can be employed as the film material. The support rods for the bag pack must extend a sufficient distance beyond the first bag of a full bag pack, e.g. a pack of 125 bags of 0.65 ml. film. The sufficient distance is a length which will permit the flattened loop handles to expand and permit separation of the front panel of the bag from the rear panel of the bag and permit bagging to begin.

Although the present invention has been described with preferred embodiments it is to be understood that modifications and variations may be resorted to without departing from the spirit and scope of the invention as those skilled in the art will readily understand. Such modifications and variations are considered to be within the preview and scope of the appended claims.

What is claimed is:

1. A pack of thermoplastic film bags, said bags being in at least approximately registration, each bag comprising a bottom, front and rear walls connected by way of gusseted side walls, a bag mouth, double film loop handles at opposite ends of the bag mouth, said handles being integral extensions of said walls;

said pack having pack suspension means in association with said handles about intermediate between the top and the base of said handles; and first releasable means between the upper rear portion of a lead bag and the upper front portion of the next bag, said upper portion including the portion from just below the bag mouth to the extent of the handles, which, upon removal of said lead bag from the pack, causes an initial opening of the top portion of said next bag and second releasable means located between each rear and front wall at the lower portion of each bag near the bottom of each bag to cause a more complete opening of said next bag on removal of said lead bag by the handles thereof.

2. The pack of claim 1 wherein the second releasable means is one releasable region near the bottom of the bag about equidistant from the bag sides.

3. The pack of claim 1 wherein the second releasable means is a continuous band of adhesion from one side of each bag to the other side near the bottom of the bag.

4. The pack of claim 1 wherein said first releasable means are between the handles of adjacent bags.

5. The pack of claim 1 wherein said first releasable means is just below the bag mouth of each front and rear walla.

6. The pack of claim 1 wherein any of said releasable means is a member selected from the group consisting of: a pressure formed releasable region, a pressure sensitive releasable adhesive region and a corona discharge and pressure treated region.

7. A system for suspending and dispensing grocery bags comprising in combination;

(a) a pack of thermoplastic film bags, said bags being in at least approximate registration, each bag comprising a bottom, front and rear walls connected by way of gusseted side walls, a bag mouth, double film loop handles at opposite ends of said mouth, said handles being integral extensions of said walls, said handles having suspension orifices about intermediate between the top and the base of said handles; first releasable means between the upper rear portion of a lead bag and the upper front portion of the next bag, said upper portion including the portion from just below the bag mouth to the extent of the handles and second releasable means located between each rear and front wall at the lower portion of each bag near the bottom of each adjacent bag;

(b) a rack for said bag pack comprising a pair of spaced parallel cantilevered handle support rods having free outer ends, said rods functioning to support said bag pack from said handle suspension orifices; and whereby on removal of the lead bag from a rack suspended pack, said first releasable means causes initial opening of the top region of the next bag and said second releasable means causes a more complete opening of said next bag.

8. The system of claim 7 wherein said second releasable means is one releasable region near the bottom of the bag about equidistant from the bag sides.

9. The system of claim 7 wherein the second releasable means is a continuous band of adhesion from one side of each bag to the other side near the bottom of the bag.

10. The system of claim 7 wherein said first releasable means are between the handles of adjacent bags.

11. The system of claim 7 wherein said first releasable means is just below the bag mouth of each front and rear wall.

12. The system of claim 7 wherein any of said releasable means is a member selected from the group consisting of a pressure formed releasable region, a pressure sensitive releasable adhesive region and a corona discharge pressure treated region.

* * * * *